US009839834B2

(12) United States Patent
Renshaw et al.

(10) Patent No.: US 9,839,834 B2
(45) Date of Patent: Dec. 12, 2017

(54) BOARD ROTATING MOUNTS AND METHODS OF MAKING AND USING THE SAME

(71) Applicants: David Eugene Renshaw, Alpharetta, GA (US); Curtis Eugene Renshaw, Alpharetta, GA (US)

(72) Inventors: David Eugene Renshaw, Alpharetta, GA (US); Curtis Eugene Renshaw, Alpharetta, GA (US)

( * ) Notice: Subject to any disclaimer, the term of this patent is extended or adjusted under 35 U.S.C. 154(b) by 0 days.

(21) Appl. No.: 15/437,611

(22) Filed: Feb. 21, 2017

(65) Prior Publication Data

US 2017/0157496 A1 Jun. 8, 2017

Related U.S. Application Data

(62) Division of application No. 14/563,598, filed on Dec. 8, 2014, now Pat. No. 9,573,042.

(60) Provisional application No. 61/913,232, filed on Dec. 6, 2013.

(51) Int. Cl.
*A63C 10/18* (2012.01)
*A63C 10/14* (2012.01)

(52) U.S. Cl.
CPC ..... *A63C 10/18* (2013.01); *A63C 10/14* (2013.01); *A63C 2203/54* (2013.01)

(58) Field of Classification Search
CPC ..... A63C 10/16; A63C 10/18
USPC ..... 280/14.22, 14.24, 618, 620
See application file for complete search history.

(56) References Cited

U.S. PATENT DOCUMENTS

| | | | | | |
|---|---|---|---|---|---|
| 4,964,649 | A * | 10/1990 | Chamberlin | A63C 10/14 | 280/14.22 |
| 5,028,068 | A * | 7/1991 | Donovan | A63C 10/18 | 280/14.24 |
| 5,586,779 | A * | 12/1996 | Dawes | A63C 10/18 | 280/14.24 |
| 5,913,530 | A * | 6/1999 | Berger | A63C 10/10 | 280/14.21 |
| 6,062,584 | A * | 5/2000 | Sabol | A63C 10/14 | 280/14.24 |
| 6,203,051 | B1 * | 3/2001 | Sabol | A63C 10/14 | 280/14.24 |
| 6,467,794 | B1 * | 10/2002 | De France | A63C 10/14 | 280/607 |
| 6,491,310 | B1 * | 12/2002 | Work | A63C 10/14 | 280/14.24 |
| 6,910,706 | B2 * | 6/2005 | Holzer | A63C 5/128 | 280/14.24 |
| 7,059,614 | B2 * | 6/2006 | Cole | A63C 10/14 | 280/14.22 |
| 7,090,228 | B2 * | 8/2006 | Reynolds | A63C 10/18 | 280/14.21 |
| 7,270,337 | B1 * | 9/2007 | Carotenuto | A63C 10/14 | 280/14.24 |
| 7,416,191 | B2 * | 8/2008 | Yoshino | A63C 10/14 | 280/14.22 |
| 7,658,398 | B2 | 2/2010 | Panzeri | | |
| 7,815,214 | B2 | 10/2010 | Sabol | | |
| 7,832,742 | B1 | 11/2010 | Duggan | | |

(Continued)

*Primary Examiner* — Jeffrey J Restifo
(74) *Attorney, Agent, or Firm* — Withers & Keys, LLC

(57) ABSTRACT

Board rotating mounts, a kit containing board rotating mount components, and methods of making and using board rotating mounts are described herein.

20 Claims, 9 Drawing Sheets

(56) References Cited

U.S. PATENT DOCUMENTS

| | | | | |
|---|---|---|---|---|
| 8,128,117 | B2 * | 3/2012 | Neiley | A63C 10/18 280/14.21 |
| 8,596,668 | B2 * | 12/2013 | Van Bregmann, Jr. | A63C 10/14 280/14.24 |
| 8,870,212 | B2 * | 10/2014 | Noyes | A63C 10/18 280/612 |
| 9,573,042 | B2 * | 2/2017 | Renshaw | A63C 10/14 |
| 2003/0038455 | A1 * | 2/2003 | Lett | A63C 10/18 280/618 |
| 2003/0090072 | A1 * | 5/2003 | Cole, III | A63C 10/14 280/14.24 |
| 2003/0230870 | A1 * | 12/2003 | Sabol | A63C 10/14 280/618 |
| 2014/0265179 | A1 * | 9/2014 | Cole, III | A63C 10/18 280/14.24 |
| 2015/0157922 | A1 * | 6/2015 | Renshaw | A63C 10/14 280/14.22 |
| 2017/0157496 | A1 * | 6/2017 | Renshaw | A63C 10/18 |

* cited by examiner

BOARD ROTATING MOUNTS AND METHODS OF MAKING AND USING THE SAME

CROSS-REFERENCE TO RELATED APPLICATIONS

This patent application is a divisional patent application of U.S. Utility patent application Ser. No. 14/563,598 entitled "BOARD ROTATING MOUNTS AND METHODS OF MAKING AND USING THE SAME" filed on Dec. 8, 2014, now U.S. Pat. No. 9,573,042, which claims the benefit of priority to U.S. provisional patent application serial number entitled "BOARD ROTATING MOUNTS AND METHODS OF MAKING AND USING THE SAME" filed on Dec. 6, 2013, the subject matter of both of which are incorporated herein by reference in their entirety.

TECHNICAL FIELD

The present invention relates to board (e.g., snowboard) rotating mounts, methods of making board rotating mounts, and methods of using board rotating mounts to bind a boot or boot binding to a board, such as a snowboard or kiteboard.

BACKGROUND

Although known board rotating mounts are available for use, for example, by snowboarders, currently available board rotating mount shave one or more shortcomings. Such shortcomings include, but are not limited to, (i) the inability of the board rotating mount to bind to various types of snowboards (e.g., channel boards, 3-hole boards, and 4-hole boards), (ii) the inability of the board rotating mount to provide 360° freedom of movement without tension or stops for the user (e.g., a snowboarder), (iii) the complexity of the board rotating mount, and (iv) the lack of wear-resistance and reinforced construction.

There is a need in the art for improved board rotating mounts that address one or more of the above-mentioned shortcomings in currently available board rotating mounts.

SUMMARY

The present invention addresses the problems in the art by providing improved board rotating mounts. The board rotating mounts of the present invention possess one or more of the following properties: (i) the ability to bind a boot or boot binding to various types of boards, such as various types of snowboards (e.g., channel boards, 3-hole boards, and 4-hole boards), (ii) the ability to provide 360° freedom of unrestricted movement for the user (e.g., a snowboarder), (iii) a simple construction that enables ease of use by the user (e.g., a snowboarder), and (iv) enhanced wear-resistance and reinforcement for extended use.

Accordingly, the present invention is directed to board rotating mounts for connecting a user's (e.g., snowboarder's) boot or binding to a board, such as a snowboard. In one exemplary embodiment, the board rotating mount of the present invention comprises: a top plate for binding (directly or indirectly) to a boot or boot binding; a bottom plate for binding to a board; and a bearing positioned therebetween; wherein the bottom plate comprises a first set of bottom plate holes in a hole configuration that enables connection of the bottom plate to a channel snowboard, a 3-hole snowboard and a 4-hole snowboard.

In another exemplary embodiment, the board rotating mount of the present invention comprises: a top plate for binding to a boot or boot binding, the top plate comprising an upper top plate surface and a lower top plate surface; a bottom plate for binding to a board, the bottom plate comprising an upper bottom plate surface and a lower bottom plate surface; and a bearing positioned between the lower top plate surface and the upper bottom plate surface, the bearing allowing 360° rotation of the top plate relative to the bottom plate when connected thereto; wherein no portion of the top plate is positioned underneath any portion of the bottom plate.

In yet another exemplary embodiment, the board rotating mount of the present invention comprises: a top plate for binding to a boot or boot binding, the top plate comprising an upper top plate surface and a lower top plate surface; a bottom plate for binding to a board, the bottom plate comprising an upper bottom plate surface and a lower bottom plate surface; and a bearing positioned between the lower top plate surface and the upper bottom plate surface, the bearing allowing 360° rotation of the top plate relative to the bottom plate when connected thereto; wherein the bottom plate comprising (i) a first set of bottom plate holes therein suitable for binding the bottom plate to a board and (ii) a second set of bottom plate holes therein suitable for binding the bottom plate to the bearing.

In yet another exemplary embodiment, the board rotating mount of the present invention comprises: a top plate for binding to a boot or boot binding, the top plate comprising an upper top plate surface and a lower top plate surface; a bottom plate for binding to a board, the bottom plate comprising an upper bottom plate surface and a lower bottom plate surface; and a bearing positioned between the lower top plate surface and the upper bottom plate surface, the bearing allowing 360° rotation of the top plate relative to the bottom plate when connected thereto; wherein the bearing comprising (i) an inner ring member comprising an inner set of holes therein suitable for binding the bearing to the bottom plate, (ii) an outer ring member comprising an outer set of holes therein suitable for binding the bearing to the top plate, and (iii) a plurality of ball bearings positioned between an outer peripheral surface of the inner ring member and an inner peripheral surface of the outer ring member.

In yet another exemplary embodiment, the board rotating mount of the present invention comprises: a top plate for binding to a boot or boot binding, the top plate comprising an upper top plate surface and a lower top plate surface; a bottom plate for binding to a board, the bottom plate comprising an upper bottom plate surface and a lower bottom plate surface; and a bearing positioned between the lower top plate surface and the upper bottom plate surface, the bearing allowing 360° rotation of the top plate relative to the bottom plate when connected thereto; wherein the top plate comprises (i) a first set of top plate holes therein suitable for attaching the top plate to a boot or boot binding (not shown) having a three- or four-hole configuration, and (ii) a second set of holes suitable for binding the top plate to the bearing.

In yet another exemplary embodiment, the board rotating mount of the present invention comprises: a top plate for binding to a boot or boot binding, the top plate comprising an upper top plate surface and a lower top plate surface; a bottom plate for binding to a board, the bottom plate comprising an upper bottom plate surface and a lower bottom plate surface; and a bearing positioned between the lower top plate surface and the upper bottom plate surface, the bearing allowing 360° rotation of the top plate relative to the bottom plate when connected thereto; wherein the top plate comprises (i) a set of top plate holes therein suitable for binding the top plate to the bearing, and (ii) one or more channels therein, wherein each channel is sized to (i) enable a T-nut to slide therein and (ii) enable attachment of the top plate to one or more boot or boot binding designs (e.g., the Burton EST boot binding).

In yet another exemplary embodiment, the board rotating mount of the present invention comprises: a top plate for binding to a boot or boot binding having a three-hole or four-hole configuration, the top plate comprising (i) an upper top plate surface, (ii) a lower top plate surface, and (iii) a first set of top plate holes extending from said upper top plate surface to said lower top plate surface, said first set of top plate holes being suitable for binding said top plate to a boot or boot binding; a bottom plate for binding to a board, the bottom plate comprising (i) an upper bottom plate surface, (ii) a lower bottom plate surface, and (iii) a first set of bottom plate holes extending from said upper bottom plate surface to said lower bottom plate surface, said first set of bottom plate holes being in a hole configuration that enables independent connection of said bottom plate to a channel snowboard, a 3-hole snowboard and a 4-hole snowboard; a bearing positioned between the lower top plate surface and the upper bottom plate surface, the bearing allowing 360° rotation of the top plate relative to the bottom plate when connected thereto; at least one T-nut cap member, each T-nut cap member being sized to (i) attach to the lower top plate surface between said bearing and said lower top plate surface, and (ii) secure one or more T-nuts to said top plate; and one or more T-nuts, each T-nut being sized to (i) assist with connecting said top plate to a boot or boot binding, and (ii) be positioned between said at least one T-nut cap member and said lower top plate surface.

The present invention is further directed to methods of making the disclosed board rotating mounts and components thereof. In one exemplary embodiment, the method of making the disclosed board rotating mount of the present invention comprises thermoforming (e.g., molding, shaping, or injection molding) one or more of the herein-disclosed components. The methods of making board rotating mounts of the present invention may further comprise additional method steps such as assembling/combining one or more board rotating mount components with one another.

The present invention is further directed to methods of using the disclosed board rotating mounts. In one exemplary embodiment, the method of using the disclosed board rotating mount of the present invention comprises attaching the board rotating mount to a board (e.g., a snowboard). The methods of using board rotating mounts of the present invention may further comprise additional method steps such as attaching the board rotating mount to a boot or boot binding (e.g., a boot binding for use with a snowboard) to form an assembled binding/board combination; attaching a boot to the assembled binding/board combination; and moving a distance along a surface via the boot and assembled binding/board combination.

The present invention is even further directed to kits that may be used in methods of using board rotating mounts. In one exemplary embodiment, the kit of the present invention comprises one of the disclosed board rotating mount components in combination with one or more additional kit components. Suitable additional kit components include, but are not limited to, recessed washers, special and standard nuts, and M6×12 millimeter (mm) screws, M6×14 mm screws or M6×16 mm screws, M6 channel T-nuts, or any combination thereof.

These and other features and advantages of the present invention will become apparent after a review of the following detailed description of the disclosed embodiments and the appended claims.

BRIEF DESCRIPTION OF THE DRAWINGS

The present invention is further described with reference to the appended figures, wherein.

DETAILED DESCRIPTION OF THE INVENTION

The present invention is directed to board rotating mounts. The present invention is further directed to methods of making and using board rotating mounts (e.g., with a snowboard or any other sliding board). The present invention is even further directed to kits that may be used in methods of using board rotating mounts.

As discussed above, the board rotating mounts of the present invention provide a number of advantages over known board rotating mounts. For example, the board rotating mounts of the present invention utilize top and bottom plates to limit lateral movement of a bearing positioned therebetween during impact to limit sheer motion to the bearing and keep the bearing from separating. In addition, in some embodiments, the board rotating mount comprises a raised feature on the bottom plate that butts against an inner edge of the inner ring of the bearing, which when combined with the bearing being attached to the bottom and top plates with screws, provides support to keep the bearing from deforming during impact.

The board rotating mounts of the present invention may comprise a number of components. A description of individual components and combinations of individual components is provided in the embodiments below.

Embodiments

Figure 1:
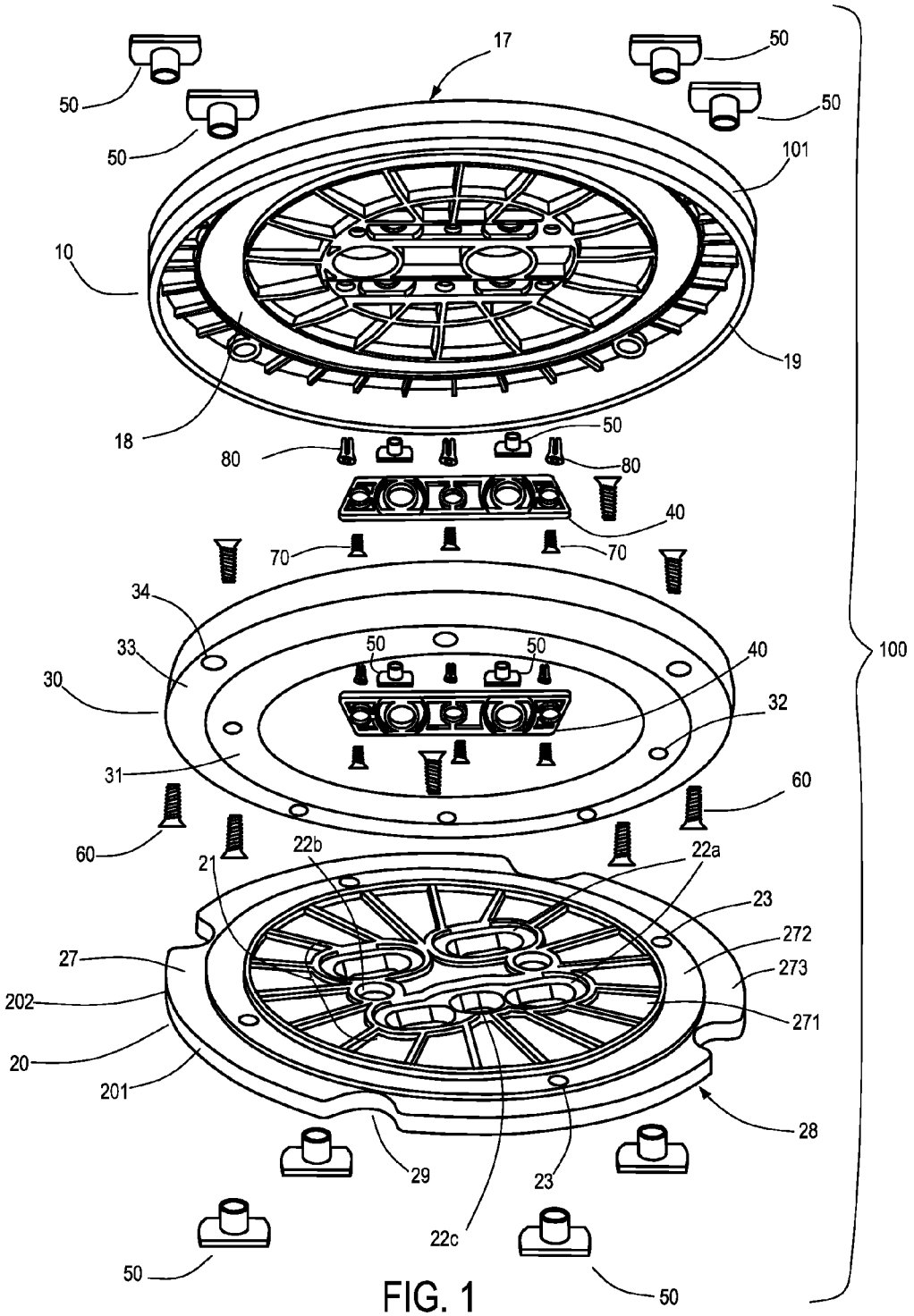
FIG. 1 depicts an exemplary board rotating mount of the present invention.
Figure 6:
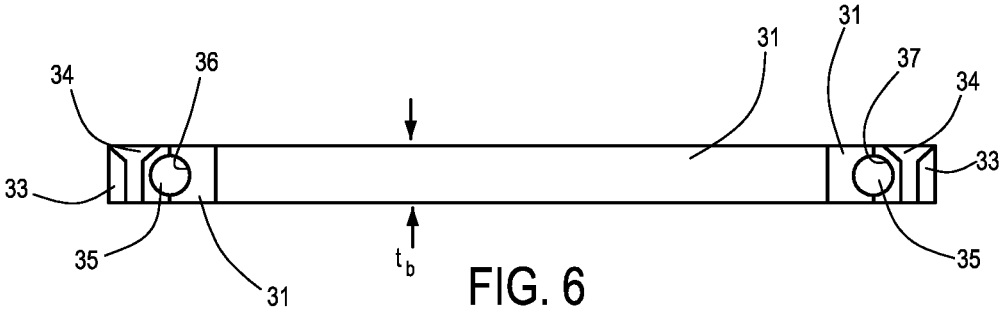
FIG. 6 depicts a cross-sectional view of the exemplary bearing shown in FIG. 5 as viewed along line 6-6 shown in FIG. 5.

Board Rotating Mounts:

1. A board rotating mount 100 comprising: a top plate 10 for binding (i.e., directly or indirectly) to a boot or boot binding (not shown); a bottom plate 20 for binding to a board (not shown); and a bearing 30 positioned therebetween; wherein said bottom plate 20 comprises a first set 21 of bottom plate holes 22*a*-22*c* in a hole configuration that enables connection of said bottom plate 20 to a channel snowboard, a 3-hole snowboard and a 4-hole snowboard. Each of bottom plate holes 22*a*-22*c* within first set 21 may independently have a hole configuration that enables insertion of a washer, a screw, or both a washer and a screw within a given bottom plate hole 22*a*, a given bottom plate hole 22*b*, and/or a given bottom plate hole 22*c*.
2. The board rotating mount 100 of embodiment 1, wherein said bearing 30 allowing 360° rotation of said top plate 10 relative to said bottom plate 20 when connected thereto.
3. The board rotating mount 100 of embodiment 1 or 2, wherein (i) said top plate 10 comprising an upper top plate surface 17 and a lower top plate surface 18; (ii) said bottom plate 20 comprising an upper bottom plate surface 27 and a lower bottom plate surface 28; and (iii) said bearing 30 allows 360° rotation of said top plate 10 relative to said bottom plate 20 when connected thereto.
4. A board rotating mount 100 comprising: a top plate 10 for binding (i.e., directly or indirectly) to a boot or boot binding (not shown), said top plate 10 comprising an upper top plate surface 17 and a lower top plate surface 18; a bottom plate 20 for binding to a board (not shown), said bottom plate 20 comprising an upper bottom plate surface 27 and a lower bottom plate surface 28; and a bearing 30 positioned between said lower top plate surface 18 and said upper bottom plate surface 27, said bearing 30 allowing 360° rotation of said top plate 10 relative to said bottom plate 20 when connected thereto; wherein no portion of said top plate 10 is positioned underneath any portion of said bottom plate 20.
5. A board rotating mount 100 comprising: a top plate 10 for binding to a boot or boot binding (not shown), said top plate 10 comprising an upper top plate surface 17 and a lower top plate surface 18; a bottom plate 20 for binding to a board (not shown), said bottom plate 20 comprising an upper bottom plate surface 27 and a lower bottom plate surface 28; and a bearing 30 positioned between said lower top plate surface 18 and said upper bottom plate surface 27, said bearing 30 allowing 360° rotation of said top plate 10 relative to said bottom plate 20 when connected thereto; wherein said bottom plate 20 comprising (i) a first set 21 of bottom plate holes 22*a*-22*c* therein suitable for binding said bottom plate 20 to a snowboard and (ii) a second set 23 of bottom plate holes 23 therein suitable for binding said bottom plate 20 to said bearing 30.
6. A board rotating mount 100 comprising: a top plate 10 for binding to a boot or boot binding (not shown), said top plate 10 comprising an upper top plate surface 17 and a lower top plate surface 18; a bottom plate 20 for binding to a board (not shown), said bottom plate 20 comprising an upper bottom plate surface 27 and a lower bottom plate surface 28; and a bearing 30 positioned between said lower top plate surface 18 and said upper bottom plate surface 27, said bearing 30 allowing 360° rotation of said top plate 10 relative to said bottom plate 20 when connected thereto; wherein said bearing 30 comprising (i) an inner ring member 31 comprising an inner set 32 of holes 32 therein suitable for binding said bearing 30 to said bottom plate 20, (ii) an outer ring member 33 comprising an outer set 34 of holes 34 therein suitable for binding said bearing 30 to said top plate 10, and (iii) a plurality of ball bearings 35 positioned between an outer peripheral surface 36 of said inner ring member 31 and an inner peripheral surface 37 of said outer ring member 33. See, for example, FIGS. 1 and 6.
7. The board rotating mount 100 of any one of embodiments 4 to 6, wherein said bottom plate 20 comprises a first set 21 of bottom plate holes 22*a*-22*c* in a hole configuration that enables connection of said bottom plate 20 to a channel snowboard, a 3-hole snowboard and a 4-hole snowboard (not shown).
8. The board rotating mount 100 of any one of embodiments 1 to 3 and 5 to 7, wherein no portion of said top plate 10 is positioned underneath any portion of said bottom plate 20.
9. The board rotating mount 100 of any one of embodiments 1 to 4 and 6 to 8, wherein said bottom plate 20 comprising (i) a first set 21 of bottom plate holes 22*a*-22*c* therein suitable for binding said bottom plate 20 to a board and (ii) a second set 23 of bottom plate holes 23 therein suitable for binding said bottom plate 20 to said bearing 30.
10. The board rotating mount 100 of any one of embodiments 1 to 5 and 7 to 9, wherein said bearing 30 comprising (i) an inner ring member 31 comprising an inner set 32 of holes 32 therein suitable for binding said bearing 30 to said bottom plate 20, (ii) an outer ring member 33 comprising an outer set 34 of holes 34 therein suitable for binding said bearing 30 to said top plate 10, and (iii) a plurality of ball bearings 35 positioned between an outer peripheral surface 36 of said inner ring member 31 and an inner peripheral surface 37 of said outer ring member 33. See, for example, FIG. 6.

11. The board rotating mount 100 of any one of embodiments 1 to 3, 5 and 7 to 10, wherein said first set 21 of bottom plate holes 22a-22c comprises seven separate holes 22a-22c.

Figure 2:
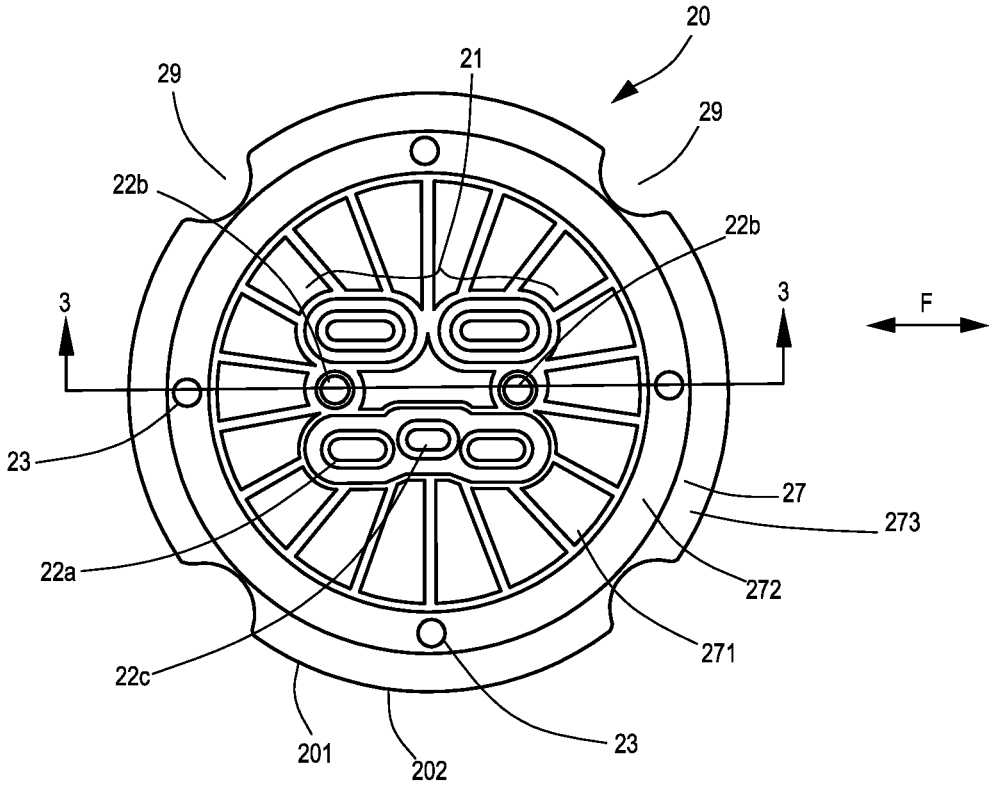
FIG. 2 depicts a top view of an exemplary bottom plate suitable for use in the exemplary board rotating mount shown in FIG. 1.

12. The board rotating mount 100 of any one of embodiments 1 to 3, 5 and 7 to 11, wherein said first set 21 of bottom plate holes 22a-22c comprises (i) four separate bottom plate holes 22a in a substantially square or rectangular configuration, (ii) two separate bottom plate holes 22b positioned along opposite edges of said substantially square or rectangular configuration and along a line (i.e., line 3-3 shown in FIG. 2) dissecting said substantially square or rectangular configuration, and (iii) a single bottom plate hole 22c positioned between two bottom plate holes 22a of said four separate bottom plate holes 22a and on one side of said line. It should be noted that although the embodiment shown in FIG. 2 shows two separate bottom plate holes 22b positioned along opposite edges of said substantially square or rectangular configuration and along a line (i.e., line 3-3 shown in FIG. 2) dissecting said substantially square or rectangular configuration, in some embodiments, first set 21 of bottom plate holes 22a-22c may comprise, in addition to or in place of the two bottom plate holes 22b shown, two bottom plate holes 22b positioned along a line perpendicular to line 3-3 shown in FIG. 2 and outside of holes 22a and 22c for a total of two or four bottom plate holes 22b.

13. The board rotating mount 100 of any one of embodiments 1 to 3, 5 and 7 to 12, wherein said first set 21 of bottom plate holes 22a-22c comprises (i) four separate bottom plate holes 22a in a substantially square or rectangular configuration, each of said four separate bottom plate holes 22a comprising an elongated bottom plate hole 22a with a longest hole dimension extending in a first direction (i.e., see, direction F shown in FIG. 2), (ii) two separate bottom plate holes 22b positioned along opposite edges of said substantially square or rectangular configuration and along a line (i.e., line 3-3 shown in FIG. 2) dissecting said substantially square or rectangular configuration, said line being substantially parallel with said longest hole dimension, and (iii) a single bottom plate hole 22c positioned between two bottom plate holes 22a of said four separate bottom plate holes 22a, on one side of said line, and closer to said line than said two bottom plate holes 22a of said four separate bottom plate holes 22a. See, for example, FIG. 2.

Figure 3:
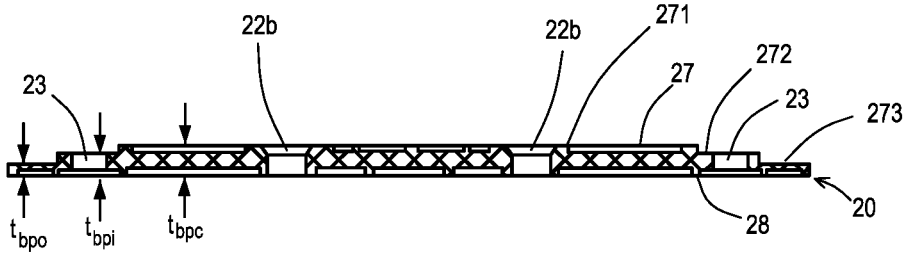
FIG. 3 depicts a cross-sectional view of the exemplary bottom plate shown in FIG. 2 as viewed along line 3-3 shown in FIG. 2.
Figure 4:
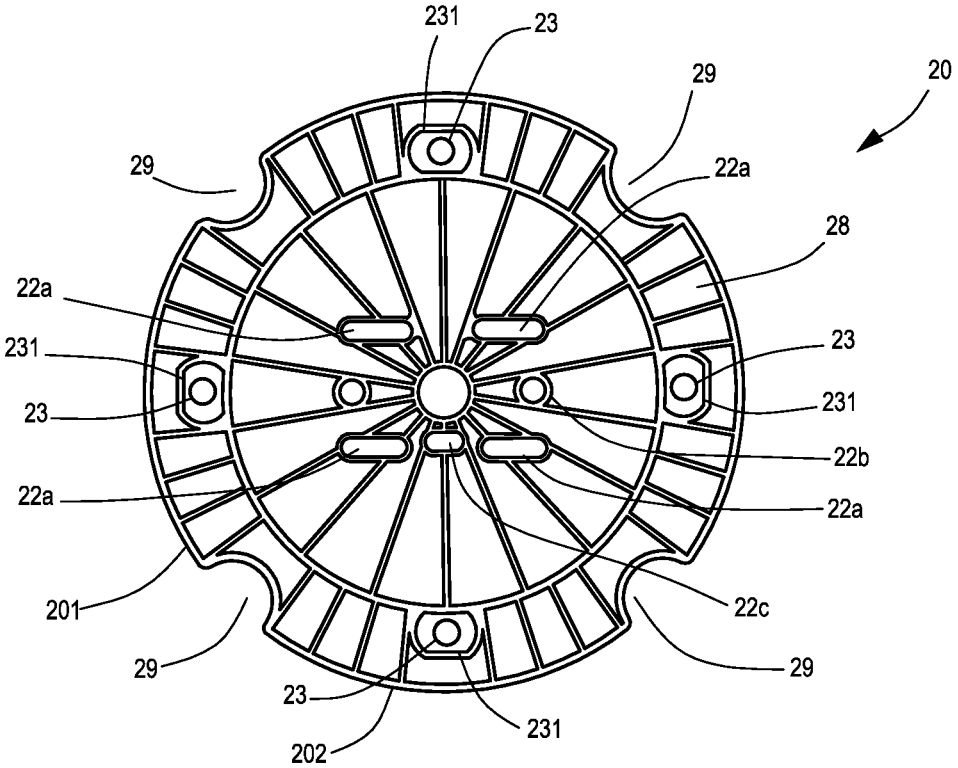
FIG. 4 depicts a bottom view of the exemplary bottom plate shown in FIG. 2.
Figure 5:
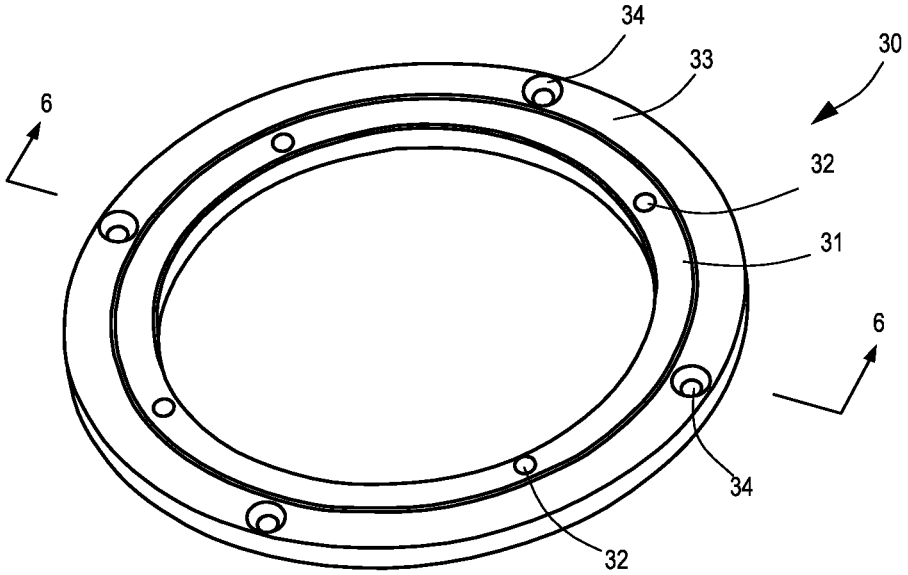
FIG. 5 depicts a view of an exemplary bearing suitable for use in the exemplary board rotating mount shown in FIG. 1.

14. The board rotating mount 100 of any one of embodiments 1 to 13, wherein said bottom plate 20 further comprises (i) a bottom plate central circular section 271, (ii) a bottom plate outer ring portion 273, and (iii) a bottom plate intermediate ring portion 272 between said bottom plate central circular section 271 and said bottom plate outer ring portion 273, said bottom plate central circular section 271 having a first bottom plate thickness $t_{bpc}$, said bottom plate intermediate ring portion 272 having a second bottom plate thickness $t_{bpi}$, and said bottom plate outer ring portion 273 having a third bottom plate thickness $t_{bpo}$ with said first bottom plate thickness $t_{bpc}$ being greater than said second bottom plate thickness $t_{bpi}$ and said third bottom plate thickness $t_{bpo}$. It should be noted that although bottom plate 20 is shown in FIG. 3 as having a flat lower bottom plate surface 28 (i.e., portions of each of (i) bottom plate central circular section 271, (ii) bottom plate outer ring portion 273, and (iii) bottom plate intermediate ring portion 272 along lower bottom plate surface 28 are within a given plane), lower bottom plate surface 28 may be configured to have an increased thickness such that portions of each of (i) bottom plate central circular section 271, (ii) bottom plate outer ring portion 273, and (iii) bottom plate intermediate ring portion 272 are not within a given plane. For example, in some embodiments, lower bottom plate surface 28 may have a surface configuration wherein bottom plate outer ring portion 273 and bottom plate intermediate ring portion 272 are within a given plane, but at least a portion of (or all of) bottom plate central circular section 271 is not due to an increased thickness of at least a portion of (or all of) bottom plate central circular section 271. In some embodiments, a portion of bottom plate central circular section 271 that encompasses (i.e., circles) all of holes 22a, 22b and 22c has an increased thickness compared to other portions of bottom plate central circular section 271, intermediate ring portion 272 and bottom plate outer ring portion 273. For example, in some embodiments, a portion of bottom plate central circular section 271 that (i) encompasses all of holes 22a, 22b and 22c, (ii) extends (1) along an outer left edge of bottom plate central circular section 271, (2) from the outer left edge of bottom plate central circular section 271 to an outer right edge of bottom plate central circular section 271, (3) along the outer right edge of bottom plate central circular section 271 and (4) from the outer right edge of bottom plate central circular section 271 back to the outer left edge of bottom plate central circular section 271 (as viewed in FIG. 4) so as to form a four-sided raised portion, but (iii) does not include upper and lower portions of bottom plate central circular section 271 (as viewed in FIG. 4) (e.g., semi-circular-shaped or convex-shaped upper and lower portions of bottom plate central circular section 271), has an increased thickness compared to the upper and lower portions of bottom plate central circular section 271 (as viewed in FIG. 4) (e.g., semi-circular-shaped or convex-shaped upper and lower portions of bottom plate central circular section 271), intermediate ring portion 272 and bottom plate outer ring portion 273. In other embodiments, a portion of bottom plate central circular section 271 is in the form of a rim or thickened section that (i) circles all of holes 22a, 22b and 22c, extends (1) along an outer left edge of bottom plate central circular section 271, (2) from the outer left edge of bottom plate central circular section 271 to an outer right edge of bottom plate central circular section 271, (3) along the outer right edge of bottom plate central circular section 271 and (4) from the outer right edge of bottom plate central circular section 271 back to the outer left edge of bottom plate central circular section 271 (as viewed in FIG. 4), but (iii) does not include (1) upper and lower portions of bottom plate central circular section 271 (e.g., semi-circular-shaped or convex-shaped upper and lower portions of bottom plate central circular section 271) and (2) portions of bottom plate central circular section 271 between the rim or thickened section and each of holes 22a, 22b and 22c (as viewed in FIG. 4), has an increased thickness compared to the upper and lower portions of bottom plate central circular section 271 (e.g., semi-circular-shaped or convex-shaped upper and lower portions of bottom plate central circular section 271), the portions of bottom plate central circular section 271 between the rim or thickened section and each of holes 22a, 22b and 22c (as viewed in FIG. 4), intermediate ring portion 272 and bottom plate outer ring portion 273. In other embodiments, at least a portion of (or all of) (i) intermediate ring portion 272, (ii) bottom plate outer ring portion 273, or (iii) both (i) and (ii) has an increased thickness compared to bottom plate central circular section 271, and other portions of (i) intermediate ring portion 272, (ii) bottom plate outer ring portion 273 or (iii) all or portions of both (i) and (ii). For example, an outer rim extending along an outer perimeter of bottom plate outer ring portion 273 may have an increased thickness compared to bottom plate central circular section 271, intermediate ring portion 272 and inner portions of bottom plate outer ring portion 273.

15. The board rotating mount 100 of embodiment 14, wherein said second bottom plate thickness $t_{bpi}$ is equal to or greater than said third bottom plate thickness $t_{bpo}$.

16. The board rotating mount 100 of embodiment 14 or 15, wherein said second bottom plate thickness $t_{bpi}$ is greater than said third bottom plate thickness $t_{bpo}$.

17. The board rotating mount 100 of any one of embodiments 14 to 16, wherein portions of said bottom plate 20 extending across a width of said lower bottom plate surface 28 are substantially within a given plane, while portions of said bottom plate 20 extending across said upper bottom plate surface 27 are not within a given plane and account for said first, second and third bottom plate thicknesses.

18. The board rotating mount 100 of any one of embodiments 5 and 9 to 17, wherein said second set 23 of bottom plate holes 23 comprises two or more separate bottom plate holes 23 suitable for connecting said bottom plate 20 to said bearing 30.

19. The board rotating mount 100 of any one of embodiments 5 and 9 to 18, wherein said second set 23 of bottom plate holes 23 comprises two or more separate bottom plate holes 23 suitable for connecting said bottom plate 20 to said bearing 30, said two or more separate bottom plate holes 23 being substantially equally spaced from each other. See, for example, FIG. 2.

20. The board rotating mount 100 of any one of embodiments 5 and 9 to 19, wherein said second set 23 of bottom plate holes 23 comprises four separate bottom plate holes 23 suitable for connecting said bottom plate 20 to said bearing 30.

21. The board rotating mount 100 of any one of embodiments 18 to 20, wherein said two or more separate bottom plate holes 23 are positioned along said bottom plate intermediate ring portion 272 of said bottom plate 20.

22. The board rotating mount 100 of any one of embodiments 1 to 21, wherein said bottom plate 20 further comprises two or more separate indentations 29 extending into a side edge 201 of said bottom plate 20 along an outer periphery 202 of said bottom plate 20.

23. The board rotating mount 100 of any one of embodiments 1 to 22, wherein said bottom plate 20 further comprises two or more separate indentations 29 extending into a side edge 201 of said bottom plate 20 along an outer periphery 202 of said bottom plate 20, each indentation 29 having a semi-circular shape.

24. The board rotating mount 100 of embodiment 22 or 23, wherein said bottom plate 20 comprises four separate indentations 29 extending into a side edge 201 of said bottom plate 20 along an outer periphery 202 of said bottom plate 20.

25. The board rotating mount 100 of any one of embodiments 1 to 24, wherein said bottom plate 20 comprises a polymeric or metallic material.

26. The board rotating mount 100 of any one of embodiments 1 to 25, wherein said bottom plate 20 comprises a fiber-reinforced polymeric material.

27. The board rotating mount 100 of any one of embodiments 6 and 10 to 26, wherein said inner set 32 of holes 32 and said outer set 34 of holes 34 each independently comprise two or more holes 32/34.

28. The board rotating mount 100 of any one of embodiments 6 and 10 to 27, wherein said inner set 32 of holes 32 and said outer set 34 of holes 34 each independently comprise four holes 32/34.

29. The board rotating mount 100 of any one of embodiments 6 and 10 to 28, wherein each hole 32 within said inner set 32 of holes 32 is substantially equally spaced from each other, and each hole 34 within said outer set 34 of holes 34 is substantially equally spaced from each other.

30. The board rotating mount 100 of any one of embodiments 14 to 29, wherein said bearing 30 has a bearing thickness $t_b$ greater than a difference between said first bottom plate thickness $t_{bpc}$ and said second bottom plate thickness $t_{bpi}$.

31. The board rotating mount 100 of any one of embodiments 1 to 30, wherein said bearing 30 has a bearing thickness $t_b$ of from about 5.0 millimeters (mm) to about 20 mm.

32. The board rotating mount 100 of any one of embodiments 1 to 31, wherein said bearing 30 has a bearing thickness $t_b$ of about 10 mm.

33. The board rotating mount 100 of any one of embodiments 1 to 32, wherein said bearing 30 comprises polymeric or metallic material.

34. The board rotating mount 100 of any one of embodiments 1 to 33, wherein said bearing 30 comprises metallic material.

35. The board rotating mount 100 of any one of embodiments 6 and 10 to 34, wherein (i) said inner ring member 31 and said outer ring member 33 each independently comprise aluminum (e.g., heat-treated aluminum), and (ii) each ball bearing 35 comprises stainless steel.

Figure 7A:
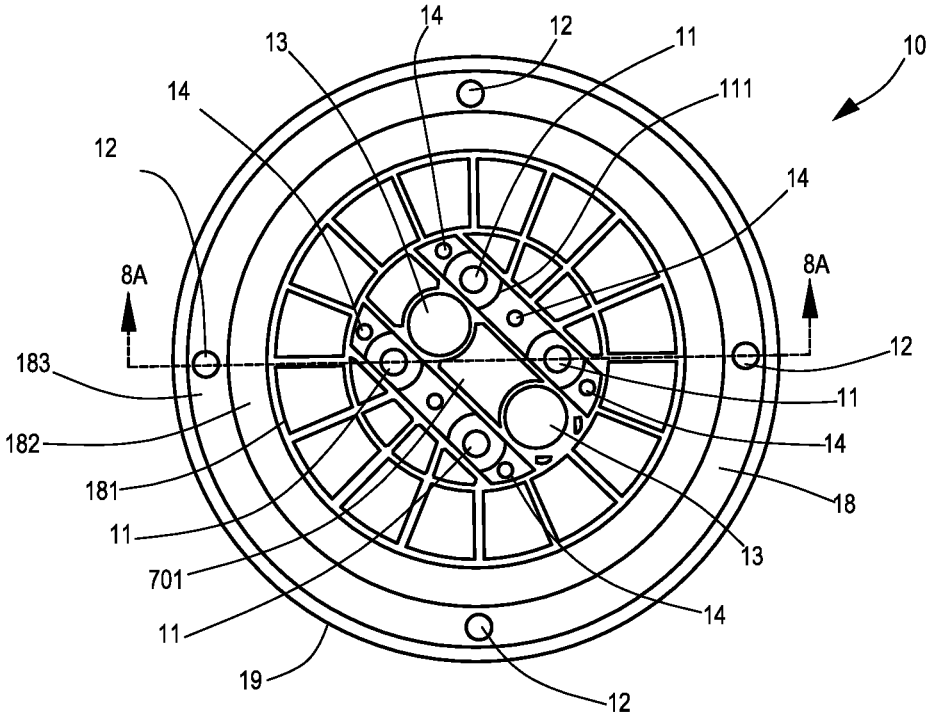
FIGS. 7A-7B depict a bottom views of exemplary top plates suitable for use in the exemplary board rotating mount shown in FIG. 1.
Figure 7B:
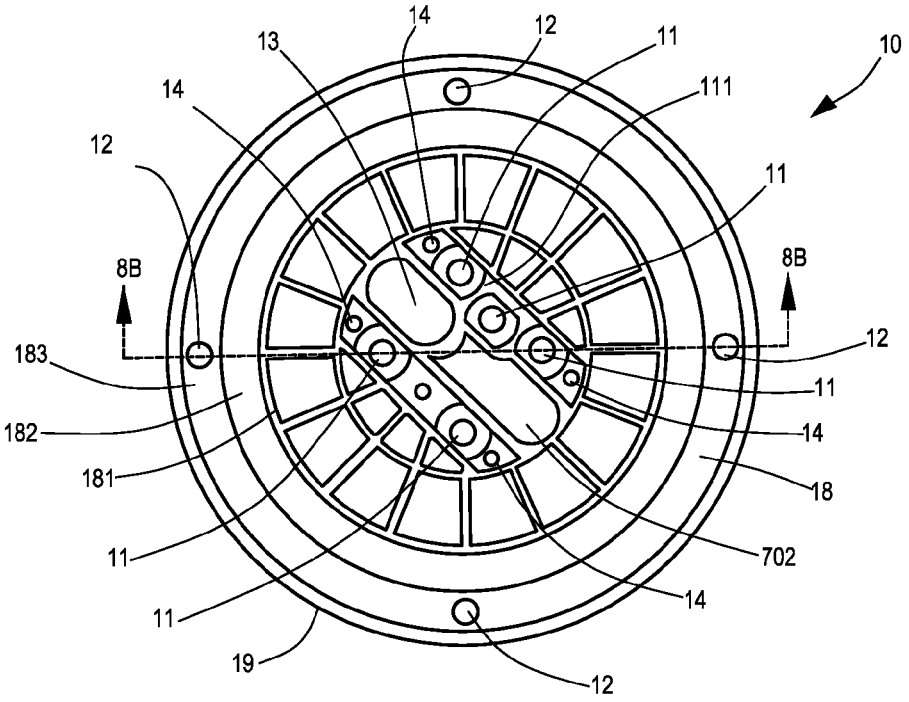

36. The board rotating mount 100 of any one of embodiments 1 to 35, wherein said top plate 10 comprises (i) a first set 11 of top plate holes 11 therein suitable for binding said top plate 10 to a boot or boot binding (not shown), and (ii) a second set 12 of top plate holes 12 therein suitable for binding said top plate 10 to said bearing 30. As shown in FIG. 7A, first set 11 of top plate holes 11 comprises four separate top plate holes 11. In an alternative embodiment shown in FIG. 7B, first set 11 of top plate holes 11 comprises five separate top plate holes 11.

37. The board rotating mount 100 of embodiment 36, wherein said first set 11 of top plate holes 11 comprises two or more separate top plate holes 11.

38. The board rotating mount 100 of embodiment 36 or 37, wherein said first set 11 of top plate holes 11 comprises four separate top plate holes 11.

39. The board rotating mount 100 of any one of embodiments 36 to 38, wherein said first set 11 of top plate holes 11 comprises four separate top plate holes 11 in a substantially square or rectangular configuration.

40. The board rotating mount 100 of embodiment 36 or 37, wherein said first set 11 of top plate holes 11 comprises three separate top plate holes 11 in a substantially equilateral triangular configuration. See, for example, top plate holes 11 shown in FIG. 7B, wherein three of the five top plate holes 11 are in a substantially equilateral triangular configuration.

41. The board rotating mount 100 of any one of embodiments 36 to 40, wherein said top plate 10 further comprises a third set 13 of one or more top plate holes 13, said third set 13 of one or more top plate holes 13 providing access to said first set 21 of bottom plate holes 22*a*-22*c* prior to or after connecting said top plate 10 and said bottom plate 20 to said bearing 30.

Figure 8A:
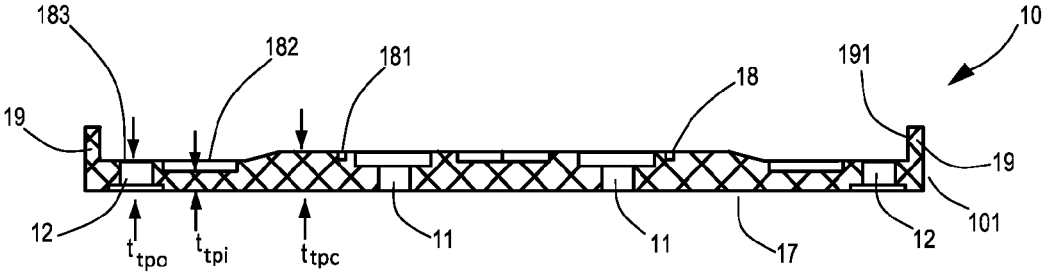
FIGS. 8A-8B depict cross-sectional views of the exemplary top plates shown in FIGS. 7A-7B as viewed along lines 8A-8A and 8B-8B shown in FIGS. 7A-7B.
Figure 8B:
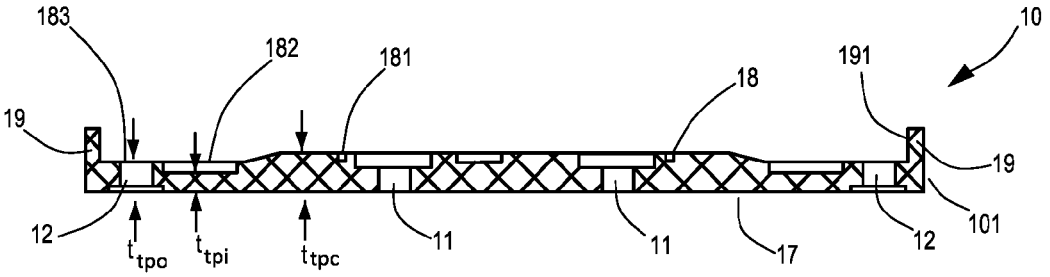

42. The board rotating mount 100 of embodiment 41, wherein said third set 13 of one or more top plate holes 13 comprises one or more separate top plate holes 13. As shown in FIG. 7A, third set 13 of one or more top plate holes 13 comprises two separate top plate holes 13. In an alternative embodiment shown in FIG. 7B, third set 13 of one or more top plate holes 13 comprises a single top plate hole 13. It should be noted that although the centrally-located areas 701 and 702 (i) between top plate holes 13 shown in FIGS. 7A-8A and (ii) between top plate hole 13 and two top plate holes 11 shown in FIGS. 7B-8B, respectively, are shown in FIGS. 8A-8B as being solid, it should be understood that any portion or all of centrally-located areas 701 and 702 can be represented by an additional opening so as to reduce the overall weight of top plate 10.

Figure 9:
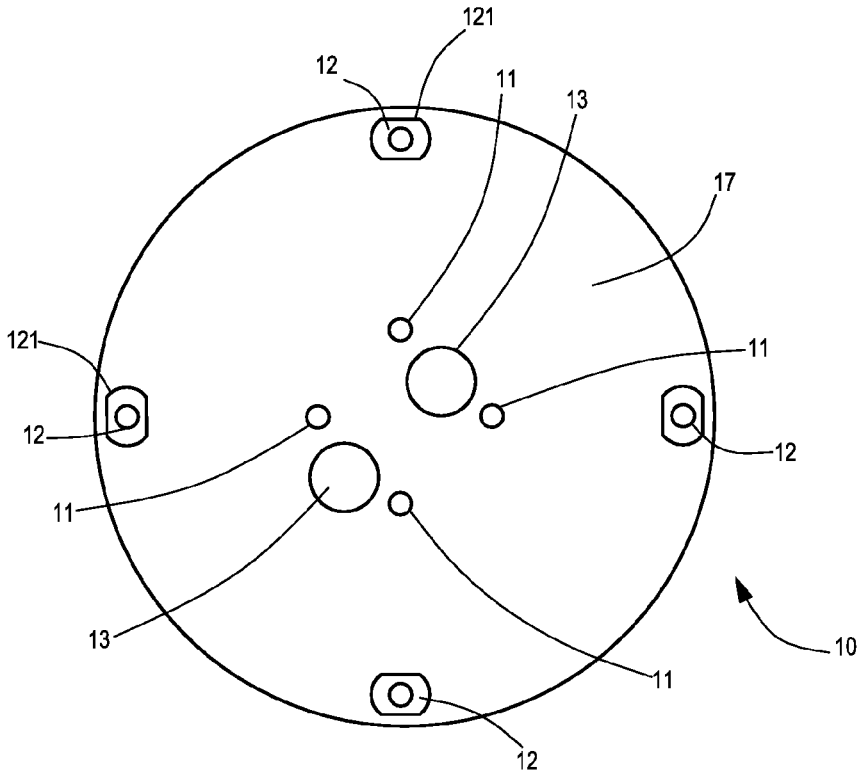
FIG. 9 depicts a top view of the exemplary top plate shown in FIG. 7A.
Figure 10A:
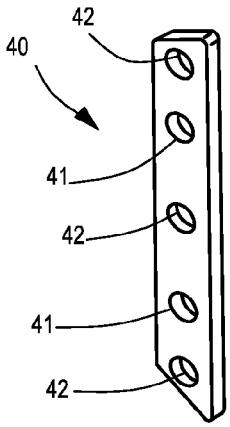
FIG. 10A depicts a view of an exemplary T-nut cap member suitable for use in the exemplary board rotating mount shown in FIG. 1.
Figure 10B:
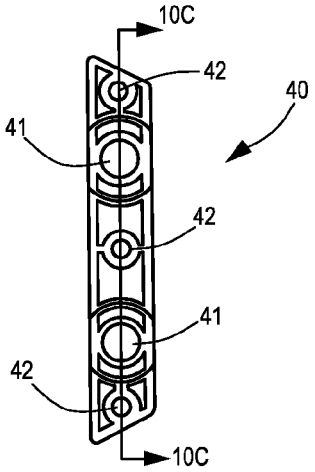
FIG. 10B depicts a top view of the exemplary T-nut cap member shown in FIG. 10A.
Figure 10C:
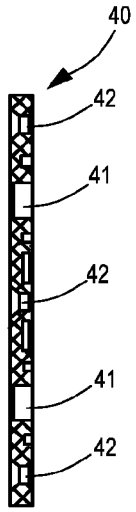
FIG. 10C depicts a cross-sectional view of the exemplary T-nut cap member shown in FIG. 10B as viewed along line 10C-10C shown in FIG. 10B.

43. The board rotating mount 100 of any one of embodiments 1 to 42, wherein said top plate 10 further comprises (i) a top plate central circular section 181, (ii) a top plate outer ring portion 183, and (iii) a top plate intermediate ring portion 182 between said top plate central circular section 181 and said top plate outer ring portion 183, said top plate central circular section 181 having a first top plate thickness $t_{tpc}$, said top plate intermediate ring portion 182 having a second top plate thickness $t_{tpi}$, and said top plate outer ring portion 183 having a third top plate thickness $t_{tpo}$ with said first top plate thickness $t_{tpc}$ being greater than said second top plate thickness $t_{tpi}$ and said third top plate thickness $t_{tpo}$. It should be noted that although top plate 10 is shown in FIGS. 8-9 as having a flat upper top plate surface 17 (i.e., portions of each of (i) a top plate central circular section 181, (ii) a top plate outer ring portion 183, and (iii) a top plate intermediate ring portion 182 between said top plate central circular section 181 and said top plate outer ring portion 183 along upper top plate surface 17 are within a given plane), upper top plate surface 17 may be configured to have an increased thickness such that portions of each of (i) a top plate central circular section 181, (ii) a top plate outer ring portion 183, and (iii) a top plate intermediate ring portion 182 are not within a given plane. For example, in some embodiments, upper top plate surface 17 may have a surface configuration wherein top plate outer ring portion 183 and top plate intermediate ring portion 182 are within a given plane, but at least a portion of (or all of) top plate central circular section 181 is not due to an increased thickness of at least a portion of (or all of) top plate central circular section 181.

44. The board rotating mount 100 of embodiment 43, wherein said third top plate thickness $t_{tpo}$ is equal to or greater than said second top plate thickness $t_{tpi}$.

45. The board rotating mount 100 of embodiment 43 or 44, wherein said third top plate thickness $t_{tpo}$ is greater than said second top plate thickness $t_{tpi}$.

46. The board rotating mount 100 of any one of embodiments 36 to 45, wherein said second set 12 of top plate holes 12 comprises two or more separate top plate holes 12 suitable for connecting said top plate 10 to said bearing 30.

47. The board rotating mount 100 of any one of embodiments 36 to 46, wherein said second set 12 of top plate holes 12 comprises two or more separate top plate holes 12 suitable for connecting said top plate 10 to said bearing 30, said two or more separate top plate holes 12 being substantially equally spaced from each other. See, for example, FIGS. 7A-7B.

48. The board rotating mount 100 of any one of embodiments 36 to 47, wherein said second set 12 of top plate holes 12 comprises four separate top plate holes 12 suitable for connecting said top plate 10 to said bearing 30.

49. The board rotating mount 100 of any one of embodiments 46 to 48, wherein said two or more separate top plate holes 12 are positioned along said top plate outer ring portion 183.

50. The board rotating mount 100 of any one of embodiments 36 to 49, wherein said top plate 10 further comprises a fourth set 14 of top plate holes 14, said fourth set 14 of top plate holes 14 being suitable for connecting one or more T-nut cap members 40 to said lower top plate surface 18.

51. The board rotating mount 100 of embodiment 50, wherein said fourth set 14 of top plate holes 14 comprises two or more separate top plate holes 14.

52. The board rotating mount 100 of embodiment 50 or 51, wherein said fourth set 14 of top plate holes 14 comprises four or more separate top plate holes 14.

53. The board rotating mount 100 of any one of embodiments 50 to 52, wherein said fourth set 14 of top plate holes 14 comprises six separate top plate holes 14.

54. The board rotating mount 100 of any one of embodiments 50 to 53, wherein said fourth set 14 of top plate holes 14 comprises six separate top plate holes 14, said six separate top plate holes 14 being arranged in two lines of three holes 14 each. See, for example, FIG. 7A.

55. The board rotating mount 100 of any one of embodiments 50 to 54, wherein said fourth set 14 of top plate holes 14 comprises six separate top plate holes 14, said six separate top plate holes 14 being arranged in two lines of three holes 14 with each hole 14 in each line being separated from one another by a hole 11 within said first set 11 of top plate holes 11.

56. The board rotating mount 100 of any one of embodiments 36 to 55, wherein said top plate further comprises one or more top plate channels 110, wherein each channel has a linear configuration and is sized to (i) enable a T-nut to slide therein and (ii) enable attachment of the top plate to one or more boot or boot binding designs (e.g., the Burton EST boot binding).

57. The board rotating mount 100 of any one of embodiments 1 to 56, wherein said top plate 10 has an overall circular shape.

58. The board rotating mount 100 of any one of embodiments 1 to 57, wherein said top plate 10 further comprises a rim 19 extending along a peripheral edge 101 of said top plate 10, said rim 19 forming a top plate side wall 191 extending downward from said lower top plate surface 18.

59. The board rotating mount 100 of embodiment 58, wherein said top plate side wall 191 extends a distance that is greater than a thickness of said bearing $t_b$.

60. The board rotating mount 100 of any one of embodiments 1 to 59, wherein said top plate 10 comprises a polymeric or metallic material.

61. The board rotating mount 100 of any one of embodiments 1 to 60, wherein said top plate 10 comprises a fiber-reinforced polymeric material.

62. The board rotating mount 100 of any one of embodiments 1 to 61, further comprising at least one T-nut cap member 40, each T-nut cap member 40 being sized to (i) attach to said lower top plate surface 18 and (ii) secure one or more T-nuts 50 to said top plate 10.

63. The board rotating mount 100 of any one of embodiments 1 to 62, further comprising two T-nut cap members 40, wherein each T-nut cap member 40 is sized to (i) attach to said lower top plate surface 18 and (ii) secure two T-nuts 50 to said top plate 10.

64. The board rotating mount 100 of embodiment 62 or 63, wherein each T-nut cap member 40 comprises (i) a first set 41 of T-nut cap member holes 41, each hole 41 being sized to accept a T-nut 50 therein, and (ii) a second set 42 of T-nut cap member holes 42 suitable for connecting said T-nut cap member 40 to said top plate 10.

65. The board rotating mount 100 of embodiment 64, wherein said first set 41 of T-nut cap member holes 41 comprises two separate T-nut cap member holes 41, and said second set 42 of T-nut cap member holes 42 comprises three separate T-nut cap member holes 42.

66. The board rotating mount 100 of any one of embodiments 62 to 65, wherein each T-nut cap member 40 comprises a polymeric or metallic material.

67. The board rotating mount 100 of any one of embodiments 62 to 66, wherein each T-nut cap member 40 comprises a fiber-reinforced polymeric material.

68. The board rotating mount 100 of any one of embodiments 62 to 67, wherein each T-nut cap member 40 has an overall shape that enables the T-nut cap member 40 to fit within a corresponding shape within said lower top plate surface 18.

69. The board rotating mount 100 of any one of embodiments 1 to 68, wherein any of the above-mentioned holes (e.g., holes 11, 12, 13, 14, 21, 22*a*-22*c*, 23, 32, 34, 41 and/or 42) extending through and/or into said bottom plate 20, said bearing 30, said top plate 10, and/or said at least one T-nut cap member 40 may comprise a recessed hole sized to accept (i) a cylindrically-shaped object (e.g., a threaded portion 61 of a screw 60 or a body 51 of a T-nut 50) and (ii) a head portion of the object (e.g., a screw head 62 having a flat head 63 and conical shaped portion 64 extending between the flat head 63 and the threaded portion 61 or a seat 52 of a T-nut 50).

Figure 11A:
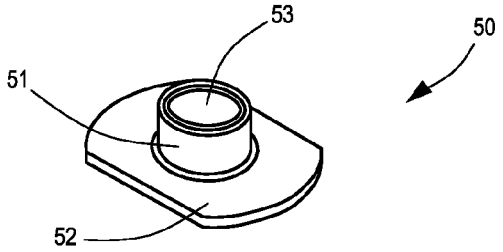
FIG. 11A depicts a view of an exemplary T-nut suitable for use in the exemplary board rotating mount shown in FIG. 1.
Figure 11B:
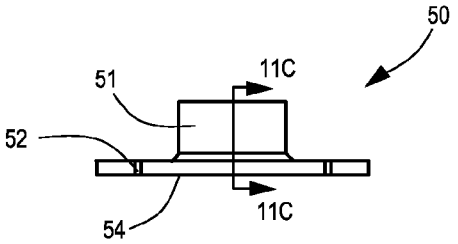
FIG. 11B depicts a side view of the exemplary T-nut shown in FIG. 11A.
Figure 11C:
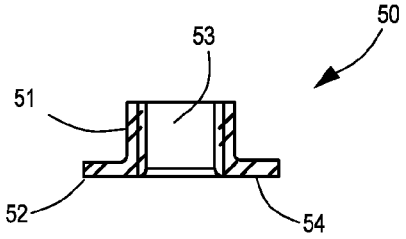
FIG. 11C depicts a cross-sectional view of the exemplary T-nut shown in FIG. 11B as viewed along line 11C-11C shown in FIG. 11B.
Figure 12:
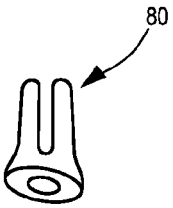
FIG. 12 depicts a view of an exemplary screw insert suitable for use in the exemplary board rotating mount shown in FIG. 1.
Figure 13:
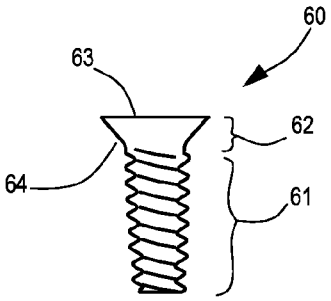
FIG. 13 depicts a view of an exemplary first screw suitable for use in the exemplary board rotating mount shown in FIG. 1.
Figure 14:
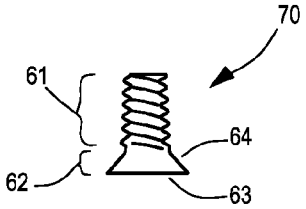
FIG. 14 depicts a view of an exemplary second screw suitable for use in the exemplary board rotating mount shown in FIG. 1.

70. The board rotating mount 100 of any one of embodiments 1 to 69, further comprising a plurality of T-nuts 50, each T-nut 50 being sized to assist with connecting (i) said top plate 10 to said bearing 30, (ii) said bottom plate 20 to said bearing 30, and/or (iii) said top plate 10 to a boot or boot binding (not shown). As shown in FIGS. 11A-11C, exemplary T-nut 50 comprises (i) a cylindrical body 51 having a cavity 53 therein, and a seat component 52 extending outward from cylindrical body 51. Cavity 53 is sized to accept and engage with a threaded portion 61 of a screw (e.g., first screw 60 shown in FIG. 13). Seat component 52 is shaped so as to engage with a corresponding shape within a recessed hole. See, for example, corresponding shapes 231 on lower bottom plate surface 28 shown in FIG. 4, corresponding shapes 111 on lower top plate surface 18 shown in FIGS. 7A-7B, and corresponding shapes 121 on upper top plate surface 17 shown in FIG. 9. Seat component 52 also has a flat surface 54 opposite cylindrical body 51 as shown in FIGS. 11B-11C so as to minimize an overall thickness of board rotating mount 100.

71. The board rotating mount 100 of any one of embodiments 1 to 70, further comprising a plurality of first screws 60, each first screw 60 being sized to assist with connecting (i) said top plate 10 to said bearing 30, and/or (ii) said bottom plate 20 to said bearing 30. See, for example, FIGS. 1 and 13.

72. The board rotating mount 100 of any one of embodiments 1 to 71, further comprising a plurality of second screws 70, each second screw 70 being sized to assist with connecting said at least one T-nut cap member 40 to said top plate 10.

73. The board rotating mount 100 of any one of embodiments 70 to 72, wherein each T-nut 50, each first screw 60, and each second screw 70 independently comprises a polymeric or metallic material.

74. The board rotating mount 100 of any one of embodiments 70 to 73, wherein each T-nut 50, each first screw 60, and each second screw 70 independently comprises stainless steel.

75. The board rotating mount 100 of any one of embodiments 1 to 74, further comprising a plurality of screw inserts 80, each screw insert 80 being sized to assist with connecting said at least one T-nut cap member 40 to said top plate 10.

76. The board rotating mount 100 of embodiment 75, wherein each screw insert 80 comprises a polymeric or metallic material.

77. The board rotating mount 100 of embodiment 75 or 76, wherein each screw insert 80 comprises brass.

78. The board rotating mount 100 of any one of embodiments 1 to 77, wherein said top plate 10 is connected to said bearing 30, and said bottom plate 20 is connected to said bearing 30.

79. A board rotating mount 100 comprising: a top plate 10 for binding to a boot or boot binding (not shown), the top plate 10 comprising an upper top plate surface 17 and a lower top plate surface 18; a bottom plate 20 for binding to a board (not shown), the bottom plate 20 comprising an upper bottom plate surface 27 and a lower bottom plate surface 28; and a bearing 30 positioned between the lower top plate surface 18 and the upper bottom plate surface 27, the bearing 30 allowing 360° rotation of the top plate 10 relative to the bottom plate 20 when connected thereto; wherein the top plate 10 comprises (i) a first set 11 of top plate holes 11 therein suitable for attaching the top plate 10 to a boot or boot binding (not shown) having a three- or four-hole configuration, and (ii) a second set 12 of holes 12 suitable for binding the top plate 10 to the bearing 30.

Figure 15A:
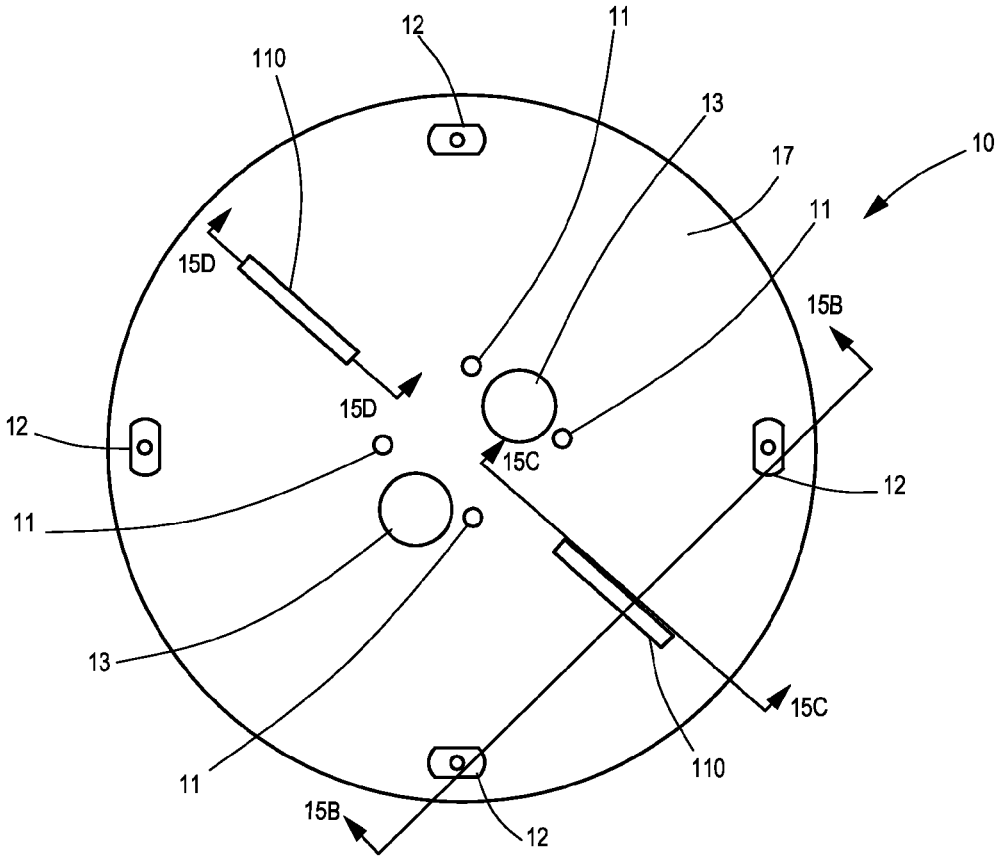
FIG. 15A depicts a top view of another exemplary top plate suitable for use in the exemplary board rotating mount shown in FIG. 1.
Figure 15B:
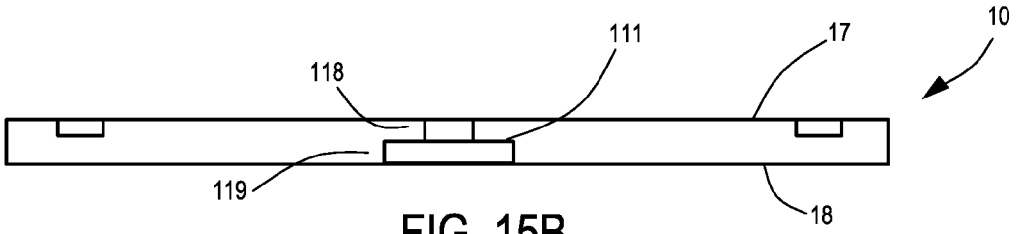
FIG. 15B depicts a cross-sectional view of the exemplary top plate shown in FIG. 15A as viewed along line 15B-15B shown in FIG. 15A.
Figure 15C:
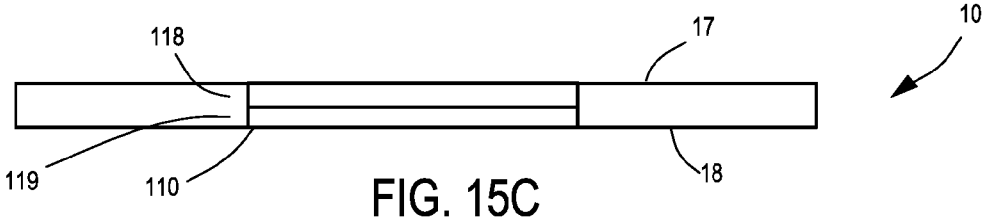
FIG. 15C depicts a cross-sectional view of the exemplary top plate shown in FIG. 15A as viewed along line 15C-15C shown in FIG. 15A.
Figure 15D:
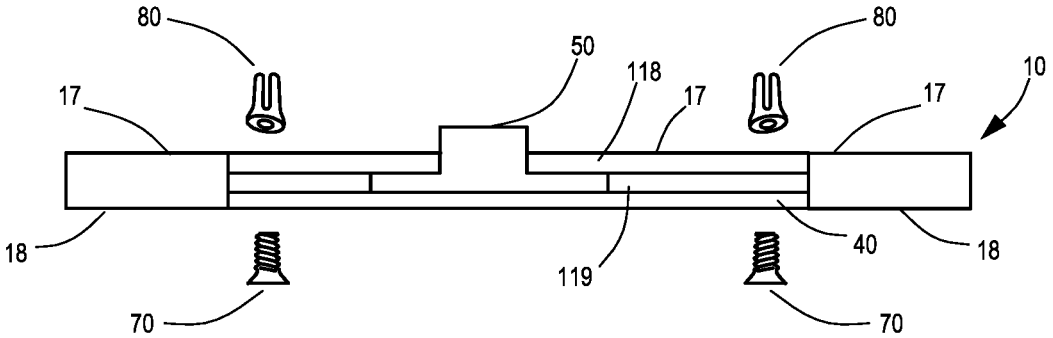
FIG. 15D depicts a view of a T-nut positioned within a channel of the exemplary top plate shown in FIG. 15A and secured into place on the exemplary top plate via a T-nut cap member.

80. A board rotating mount 100 comprising: a top plate 10 for binding to a boot or boot binding (not shown), the top plate 10 comprising an upper top plate surface 17 and a lower top plate surface 18; a bottom plate 20 for binding to a board (not shown), the bottom plate 20 comprising an upper bottom plate surface 27 and a lower bottom plate surface 28; and a bearing 30 positioned between the lower top plate surface 18 and the upper bottom plate surface 27, the bearing 30 allowing 360° rotation of the top plate 10 relative to the bottom plate 20 when connected thereto; wherein the top plate 10 comprises (i) a set of top plate holes 12 therein suitable for binding the top plate 10 to the bearing 30, and (ii) one or more channels 110 therein, wherein each channel 110 is sized to (i) enable a T-nut 50 to slide therein and (ii) enable attachment of the top plate 10 to one or more boot or boot binding designs (not shown) (e.g., the Burton EST boot binding). Typically, a given board comprises one or two separate channels 110, more desirably, two separate channels 110 as shown in FIG. 15A. As shown in FIGS. 15A-15C, each channel 110 comprises an upper channel portion 118 and a lower channel portion 119. As a given T-nut 50 slides within channel 110, cylindrical body 5 of T-nut 50 (see, FIGS. 11A-11B) slides within upper channel portion 118, while seat (or flange) component 52 slides within lower channel portion 119 (see, FIG. 15D). Each channel 110 may independently have a channel length ranging from about 1.0 inch (in) to about 4.0 in, more typically, from about 1.5 in to about 3.0 in. As shown in FIG. 15D, a T-nut cap member 40 may be used to secure a given T-nut 50 within channel 110.

81. The board rotating mount 100 of embodiment 79 or 80, further comprising any of the features or components recited in any one of embodiments 1 to 78,
82. The board rotating mount 100 of any one of embodiments 1 to 81, wherein said top plate 10 is connected to said bearing 30, said bottom plate 20 is connected to said bearing 30, and said bottom plate 20 is connected to a board (not shown).
83. The board rotating mount 100 of any one of embodiments 1 to 82, wherein said top plate 10 is connected to said bearing 30, said bottom plate 20 is connected to said bearing 30, and said bottom plate 20 is connected to a snowboard (not shown).
84. The board rotating mount 100 of any one of embodiments 1 to 83, wherein said top plate 10 is connected to said bearing 30, said bottom plate 20 is connected to said bearing 30, said bottom plate 20 is connected to a snowboard (not shown), and said top plate 10 is connected to a boot or boot binding (not shown).

Kits Comprising a Board Rotating Mount:

85. A kit comprising the board rotating mount 100 of any one of embodiments 1 to 84.
86. The kit of embodiment 85, further comprising one or more additional kit components comprising recessed washers, special and standard nuts, M6×12 millimeter (mm) screws, M6×14 mm screws, M6×16 mm screws, M6 channel T-nuts, special and standard M6 or M5 channel T-nuts, or any combination thereof.

Methods of Making Board Rotating Mounts:

87. A method of making the board rotating mount 100 of any one of embodiments 1 to 84, said method comprising: thermoforming one or more components recited in any one of embodiments 1 to 84.
88. The method of embodiment 87, wherein said thermoforming step comprises injection molding one or more components recited in any one of embodiments 1 to 84.
89. The method of embodiment 87 or 88, further comprising assembling/combining one or more board rotating mount components with one another.

Methods of Using Board Rotating Mounts:

90. A method of using the board rotating mount 100 of any one of embodiments 1 to 84, said method comprising: attaching the board rotating mount to a board (e.g., a snowboard).
91. The method of embodiment 90, further comprising attaching the board rotating mount to a boot or boot binding (e.g., a boot binding for use with a snowboard) to form an assembled binding/board combination; attaching a boot to the assembled binding/board combination; and moving a distance along a surface via the boot and assembled binding/board combination.

Although board rotating mount 100 of the present invention is described as comprising bottom plate 20 being connectable or connected to inner ring member 31 of bearing 30, and top plate 10 being connectable or connected to outer ring member 33 of bearing 30, it should be understood that other board rotating mounts of the present invention may comprise bottom plate 20 being connectable or connected to outer ring member 33 of bearing 30, and top plate 10 being connectable or connected to inner ring member 31 of bearing 30.

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

Example 1

Preparation of Board Rotating Mounts

Exemplary board rotating mounts components as shown in FIGS. 1-15D were prepared and assembled using conventional steps (e.g., one or more thermoforming steps, and one or more connection/assembly steps).

It should be understood that although the above-described board rotating mounts, kits and methods are described as "comprising" one or more components or steps, the above-described board rotating mounts, kits and methods may "comprise," "consists of," or "consist essentially of" any of the above-described components, features or steps of the board rotating mounts, kits and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a board rotating mount, kit and/or method that "comprises" a list of elements (e.g., components, features or steps) is not necessarily limited to only those elements (or components or steps), but may include other elements (or components or steps) not expressly listed or inherent to the board rotating mount, kit and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a board rotating mount, kit and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described board rotating mounts, kits and/or methods may comprise, consist essentially of, or consist of any of the herein-described components and features, as shown in the figures with or without any feature(s) not shown in the figures. In other words, in some embodiments, the board rotating mounts, kits and/or methods of the present invention do not have any additional features other than those shown in the figures, and such additional features, not shown in the figures, are specifically excluded from the board rotating mounts, kits and/or methods. In other embodiments, the board rotating mounts, kits and/or methods of the present invention do have one or more additional features that are not shown in the figures.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A board rotating mount comprising:

a top plate for binding to a boot or boot binding, said top plate comprising an upper top plate surface and a lower top plate surface;

a bottom plate for binding to a board, said bottom plate comprising an upper bottom plate surface and a lower bottom plate surface; and a bearing positioned between said lower top plate surface and said upper bottom plate surface, said bearing allowing 360° rotation of said top plate relative to said bottom plate when connected thereto;

wherein said bearing comprising (i) an inner ring member comprising an inner set of holes therein for binding said inner ring member of said bearing to said top plate, (ii) an outer ring member comprising an outer set of holes therein for binding said outer ring member of said bearing to said bottom plate, and (iii) a plurality of ball bearings positioned between an outer peripheral surface of said inner ring member and an inner peripheral surface of said outer ring member.

2. The board rotating mount of claim 1, wherein (i) said inner set of holes comprises from 2 to 4 holes equally spaced from one another, and (ii) said outer set of holes comprises from 2 to 4 holes equally spaced from one another.

3. The board rotating mount of claim 2, further comprising a plurality of first screws connecting (i) said top plate to said inner ring member of said bearing via said inner set of holes, and (ii) said bottom plate to said outer ring member of said bearing via said outer set of holes.

4. A method of using the board rotating mount of claim 1, said method comprising:

attaching the board rotating mount to a board.

5. A kit for a board rotating mount, said kit comprising:

a top plate for binding to a boot or boot binding, said top plate comprising an upper top plate surface and a lower top plate surface;

a bottom plate positionable between said lower top plate surface and an upper board surface of a board, said bottom plate comprising a first set of bottom plate holes for binding said bottom plate to the upper board surface of a board when connected thereto; and a bearing positionable between said lower top plate surface and the upper board surface of the board, said bearing allowing 360° rotation of said top plate relative to the upper board surface when connected thereto;

wherein (1) said bearing comprises (i) an outer circular member comprising an outer set of holes therein for binding said outer circular member of said bearing to said top plate, and (ii) an inner circular member comprising a central opening therethrough, and (2) no portion of said top plate is positioned underneath any portion of said bottom plate when said top plate and said bottom plate are assembled with one another and attached to the upper board surface.

6. The kit of claim 5, wherein said outer set of holes comprises 2 or more holes equally spaced from one another.

7. The kit of claim 5, wherein said bearing further comprises a plurality of ball bearings positioned between an outer peripheral surface of said inner circular member and an inner peripheral surface of said outer circular member.

8. The kit of claim 5, wherein said outer circular member is connected to said top plate.

9. A method of using the kit of claim 5, said method comprising:

connecting the outer circular member of the bearing to the top plate via the outer set of holes; and connecting the bottom plate to an upper board surface of a board via the first set of bottom plate holes.

10. The method of claim 9, wherein the bottom plate comprising a bottom plate central circular section having a bottom plate thickness $t_{bpc}$ and a bottom plate outer ring portion having a bottom plate thickness $t_{bpo}$ with the first bottom plate thickness $t_{bpc}$ being greater than the bottom plate thickness $t_{bpo}$, and wherein said connecting the bottom plate to an upper board surface of a board via the first set of bottom plate holes comprises positioning the bottom plate central circular section within the central opening of the inner circular member.

11. The method of claim 10, further comprising:

attaching a boot or boot binding to the top plate.

12. The kit of claim 5, wherein said bottom plate comprising a bottom plate central circular section having a bottom plate thickness $t_{bpc}$ and a bottom plate outer ring portion having a bottom plate thickness $t_{bpo}$ with said first bottom plate thickness $t_{bpc}$ being greater than said bottom plate thickness $t_{bpo}$.

13. The kit of claim 12, wherein, when assembled and connected to an upper board surface of a board, said bottom plate central circular section extends within said central opening of said inner circular member.

14. A kit for a board rotating mount, said kit comprising:

a top plate for binding to a boot or boot binding, said top plate comprising an upper top plate surface and a lower top plate surface; and a bearing positionable between said lower top plate surface and an upper board surface of a board, said bearing allowing 360° rotation of said top plate relative to said upper board surface when connected thereto;

wherein said bearing comprises (i) an inner circular member comprising an inner set of holes therein for binding said inner circular member of said bearing to said top plate, and (ii) an outer circular member comprising an outer set of holes therein for binding said outer circular member of said bearing to an upper board surface of a board;

further comprising a bottom plate positionable between said outer ring member of said bearing and an upper board surface of a board.

15. The kit of claim 14, wherein (i) said inner set of holes comprises from 2 to 4 holes equally spaced from one another, and (ii) said outer set of holes comprises from 2 to 4 holes equally spaced from one another.

16. The kit of claim 15, further comprising a plurality of screws for connecting (i) said inner circular member of said bearing to said top plate via said inner set of holes, and (ii) said outer circular member of said bearing to an upper board surface of a board via said outer set of holes.

17. The kit of claim 14, wherein said bearing further comprises a plurality of ball bearings positioned between an outer peripheral surface of said inner circular member and an inner peripheral surface of said outer circular member.

18. The kit of claim 14, wherein said inner circular member is connected to said top plate, and said outer circular member is connected to an upper board surface of a board.

19. The kit of claim 14, wherein said inner circular member is connected to said top plate.

20. The kit of claim 14, wherein said outer circular member is connected to an upper board surface of a board.

* * * * *